United States Patent [19]

Saka

[11] Patent Number: 5,015,976

[45] Date of Patent: May 14, 1991

[54] MICROWAVE FILTER

[75] Inventor: Hiroshi Saka, Katano, Japan

[73] Assignee: Matsushita Electric Industrial Co., Ltd., Osaka, Japan

[21] Appl. No.: 432,846

[22] Filed: Nov. 7, 1989

[30] Foreign Application Priority Data

Nov. 11, 1988 [JP] Japan ..... 63-286142
Nov. 11, 1988 [JP] Japan ..... 63-286143

[51] Int. Cl.[5] ..... H01P 1/203
[52] U.S. Cl. ..... 333/204; 333/246
[58] Field of Search ..... 333/202, 204, 205, 238, 333/246

[56] References Cited

U.S. PATENT DOCUMENTS 3,875,538 4/1975 Minet et al. ..... 333/204
4,074,214 2/1978 Aichholzer ..... 333/204

FOREIGN PATENT DOCUMENTS 0193162 9/1986 European Pat. Off. .
63-10601 3/1988 Japan .

OTHER PUBLICATIONS

Bates et al., "Designing Bandstop Filters for Microwave Frequencies", Electronic Engineering, vol. 50, No. 604, Apr. 1978, pp. 39–41.
Schiffman et al., "Exact Design of Band-Stop Microwave Filters", IEEE Trans. MTT, vol. MTT-12, Jan. 1964, pp. 6–15.
Malherbe, "TEM Pseudoelliptic-Function Bandstop Filters Using Noncommensurate Lines", IEEE Transactions on Microwave Theory and Techniques, vol. MTT-24, No. 5, pp. 242–248, May 1976.
Bates, "Design of Microstrip Spur-Line Band-Stop Filters", Microwaves-Optics and Acoustics, vol. 1, No. 6, Nov. 1977, pp. 209–214.

*Primary Examiner*—Eugene R. Laroche
*Assistant Examiner*—Seung Ham
*Attorney, Agent, or Firm*—Stevens, Davis, Miller & Mosher

[57] ABSTRACT

A microwave filter is disclosed in which open-ended lines are connected at three or four points of a main line having input and output terminals. The open-ended lines have a length about one fourth the wavelength of an image signal frequency thereby to produce a band-stop filter characteristic with an image frequency, all or parts of the open-ended lines constitute open-ended parallel-coupled lines arranged in parallel to the main line, and the intevals of connection of the open-ended lines with the main line are properly selected. The insertion loss of the filter within the pass band of a radio frequency signal is reduced and the filter attenuation within a stop band of an image signal is increased, thus providing a compact band-stop filter which has a steep rise characteristic.

10 Claims, 5 Drawing Sheets

MICROWAVE FILTER

BACKGROUND OF THE INVENTION

1. Field of the Invention

The present invention relates to a microwave filter using a strip line or a micro-strip line, or more in particular to a microwave filter configuration with a pass-band frequency higher than a stop-band frequency and both the pass-band and stop-band frequencies limited in bandwidth.

2. Description of the Prior Art

In a mixer supplied with a radio frequency signal ($f_s$ in frequency) and a local oscillation signal ($f_l$ in frequency) different in frequency from the radio frequency signal for producing an intermediate frequency signal ($f_s-f_l$ in frequency; $f_s>f_l$) making up a frequency component representing the difference between the former two signals, a filter (hereinafter called the "signal-pass image-rejection filter) for passing the radio frequency signal without loss but stopping an image signal (with frequency $f_m=2f_l-f_s$) having a frequency ($2f_l-f_s$) twice the local oscillation signal ($2f_l$) less the frequency ($f_s$) of the radio frequency signal, is inserted in a main line for transmitting the radio frequency signal to a mixer diode. Further, a local band-pass filter (hereinafter called the "local BPF") for selectively passing a local oscillation signal alone is interposed between an input terminal for the local oscillation signal and the mixer diode. Upon application of a radio frequency signal and a local oscillation signal to a mixer diode making up a non-linear element, a side band or a high harmonic of $mf_s \pm nf_l$(m, n: Integers) in frequency are generated. The waves of the image signal frequency $f_m$ and the sum frequency $f_s+f_l$ in these spectra contain a radio frequency component. By returning the image signal, in particular, out of these signals to the mixer diode through a signal-pass image-rejection filter and mixing it with the local oscillation signal again, therefore, it is possible to produce a reconverted intermediate frequency signal and thereby to reduce the conversion loss of the mixer. Further, the signal-pass image-rejection filter is capable of preventing an interference wave signal having the same frequency as the image signal frequency from entering the frequency band of the intermediate frequency signal by way of the radio frequency signal input terminal.

Especially, a single-ended mixer using only one mixer diode has the performance thereof greatly affected by the manner in which the image signal generated in the mixer diode is processed. The impedance as viewed from a diode terminal is normally set to be reactive against the image signal frequency. A signal-pass image-rejection filter and a local BPF for rejecting an image signal thus constitute indispensable elements for configuring a single-end mixer. The signal-pass image-rejection filter is provided on or in coupling with a main line for transmitting a radio frequency signal to the mixer diode, and therefore the characteristics of the signal-pass image-rejection filter have a direct effect on the mixer performance. In other words, it is not too much to say that the mixer performance is determined by the characteristics of the signal-pass image-rejection filter.

The performance described below is required of such a signal-pass image-rejection filter.

(1) A minimum insertion loss against a radio frequency signal.

(2) Characteristics to reject an image signal sufficiently.

(3) A pass bandwidth and a rejection bandwidth required for a radio frequency signal and an image signal respectively.

(4) The more steep the out-of-band characteristics, the closer the frequencies of the radio frequency signal and the image signal to each other.

A conventional signal-pass image-rejection filter used with a mixer is disclosed in JP-A-63-10601. This signal-pass image-rejection filter is shown in FIG. 9.

In FIG. 9, an input terminal 1 and an output terminal 2 for a radio frequency signal are connected by a main line 3 configured of a strip line. Open-ended stubs 4, 5, 6 having lengths of $l_1$, $l_2$, $l_3$ respectively at equal intervals of $l_0$ sequentially are connected in shunt with the main line 3. The lengths $l_1$, $l_2$, $l_3$ of the open-ended stubs 4, 5, 6 are selected as equal or near to one fourth of the wavelength of the image signal so that poles of attenuation are placed within or in the vicinity of the image signal band. The length, $l_1$, $l_2$, $l_3$ and the intervals $l_0$ of the open-ended stubs 4, 5, 6 are also determined in such a manner as to hold the relations of both $l_2<l_1<l_0<2l_2$ and $l_2<l_3<l_02l_2$ at the same time or the relations $l_2<l_1=l_3<l_0<2l_2$, while the length $l_0$ is selected at a value about 1.5 times one fourth of the wavelength of the radio frequency signal. Numerals 7, 8 designate input and output lines connected to the input and output terminals 1 and 2 respectively.

The forementioned signal-pass image-rejection filter with the open-ended stubs 4, 5, 6 projected in the directions perpendicular to the main line 3 has disadvantages in that:

(1) The fact that the open-ended stubs 4, 5, 6 are mounted in the form projected in the directions perpendicular to the main line 3 easily causes radiation, thereby increasing an insertion loss within the pass band of a radio frequency signal.

(2) The open-ended stub 5 has poles of attenuation on high-frequency side as compared with the stubs 4, 6. If the characteristic impedance of the open-ended stub 5 is increased, a filter having a comparatively steep rise characteristic would be obtained. Since there is only one open-ended stub with poles of attenuation on high frequency side, however, it is impossible to produce a filter having a steep rise characteristic.

(3) In view of the fact that the open-ended stubs 4, 5, 6 are projected in the directions perpendicular to the main line, the filter is widened for an increased filter size.

SUMMARY OF THE INVENTION

The present invention has been developed in order to obviate these disadvantages, and the object thereof is to provide a compact microwave filter small in the insertion loss caused by radiation within the pass band of a radio frequency signal and having a steep rise characteristic.

According to the present invention, there is provided a microwave filter comprising open-ended lines at three or four points on a main line, in which the length of the open-ended lines is selected at approximately one fourth the wavelength of an image signal thereby to produce band-stop filter characteristics with an image signal frequency.

In the case where open-ended lines are used at three points on the main line, first, second and third open-ended lines are sequentially connected at equal or substantially equal intervals, and the length of the open-ended lines is selected to be almost equal to one fourth the wavelength of the image signal, thus producing a band-stop filter characteristics with an image signal frequency. The first and third lines are configured of open-ended parallel-coupled lines in parallel to the main line, and the intervals between the first, second and third lines are selected at a value longer than one fourth and shorter than one half the wavelength of the image signal. Especially by selecting an interval about 1.5 times one fourth the wavelength of a radio frequency signal, band-pass filter characteristics are obtained with the frequency of the radio frequency signal.

When open-ended lines are connected at four points on the main line, on the other hand, the filter is configured of a main line and first, second, third and fourth open-ended parallel-coupled lines with one end of each thereof connected sequentially to the main line at intervals of $l_0$, $l_1$, $l_0'$ ($l_0 \approx l_0'$) respectively. The first, second, third and fourth parallel-coupled lines, which have the length of $l_2$, $l_3$, $l_3'$, $l_2'$ respectively, are parallel-coupled with the main line. The lengths $l_2$, $l_3$, $l_3'$, $l_2'$ are selected to be equal to one fourth the wavelength of the stop-band frequency in such a manner that poles of attenuation thereof are placed within a stop band. At the same time, the lengths $l_0$, $l_0'$, $l_1$, $l_2$, $l_2'$, $l_3$, $l_3'$ are determined in such a way as to satisfy the conditions $l_1 < (l_3$ and $l_3') < (l_2$ and $l_2') < (l_0$ and $l_0') < (2l_3$and $2l_3')$ or $l_1 < l_3 \approx l_3' < l_2 \approx l_2' < l_0 \approx l_0' < (2l_3$ and $2l_3')$.

A microwave filter according to the present invention has a feature in that a main line is arranged in opposed relationship with a pair of first and second parallel-coupled lines and a pair of the third and fourth parallel-coupled lines, or in that the characteristic impedance of the parallel-coupled open-ended first, second, third and fourth lines is selected at a value higher than that of the input and output lines connected to an input or output line.

According to one aspect of the present invention, the fact that each parallel-coupled line is arranged in parallel and coupled with a main line reduces the radiation loss of the filter due to the radiation from the open ends of the parallel-coupled lines, with the result that the filter insertion loss is decreased within the pass-band of the radio frequency signal and the filter attenuation is increased within the stop-band of the image signal.

According to another aspect of the present invention, the characteristic impedance of a parallel-coupled line with poles of attenuation thereof on the side nearer to the pass band of the radio frequency signal is set higher than the characteristic impedance of input and output lines, whereby the quality factor (Q) within the stop band of the parallel-coupled line is increased while at the same time filter characteristics including a steep rise characteristic are obtained due to the fact that the poles of attenuation are comprised of two parallel-coupled lines.

According to still another aspect of the present invention, parallel-coupled lines are arranged parallel to a main line, and therefore the width of the filter as a whole is reduced for a decreased filter size.

DESCRIPTION OF THE PREFERRED EMBODIMENTS

Figure 1:
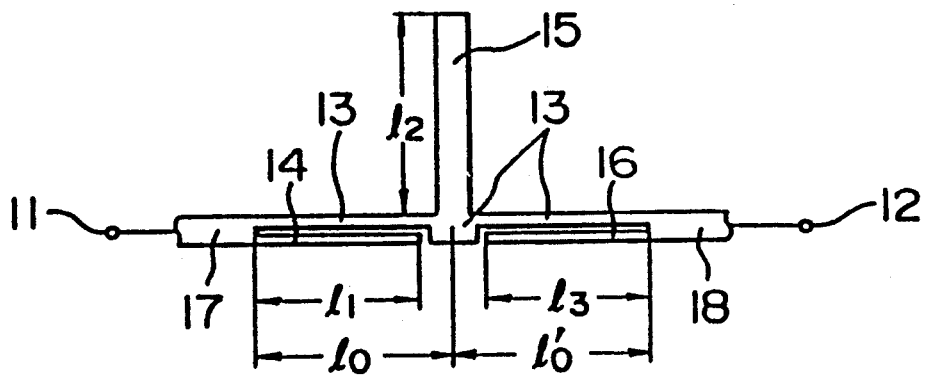
FIG. 1 is a diagram showing a pattern of a microwave filter circuit configured of a strip line according to a first embodiment of the present invention.

A signal-pass image-rejection filter according to a first embodiment of the present invention is shown in FIG. 1. An input terminal 11 and an output terminal 12 for a radio-frequency signal are connected by a main line 13 composed of a strip line. Open-ended parallel-coupled lines 14 and 16 having the length of $l_1$ and $l_3$ respectively are parallel-coupled to the main line 13, and the open-ended stub 15 having the length of $l_2$ is connected in shunt with the main line 13. Further, the parallel-coupled line 14, the open-ended stub 15 and the parallel-coupled line 16 are connected to the main line 13 at the interval of $l_0$, $l_0'$($l_0 \approx l_0'$) respectively. The lengths $l_1$, $l_2$ and $l_3$ of the open-ended parallel-coupled line 14, the stub 15 and the parallel-coupled line 16 are selected to be one fourth or substantially one fourth the wavelength of the image signal in such a manner that poles of attenuation thereof are placed within or in the vicinity of the band of the image signal. The lengths $l_1$, $l_3$ of the parallel-coupled lines 14 and 16, the length $l_2$ of the open-ended stub 15 and the interval $l_0$, $l_0'$ are selected in such a way as to satisfy the conditions of both $l_1 \approx l_2 < l_0 \approx l_0' < 2l_1$ and $l_3 \approx l_2 < l_0 \approx l_0' < 2l_3$ at the same time or the condition $l_1 = l_3 \approx l_2 < l_0 \approx l_0' < 2l_1$. On the other hand, the length $l_0$, $l_0'$ are determined at a value about 1.5 times one fourth of the wavelength of the radio frequency signal, and the characteristic impedance of the parallel-coupled lines 14 and 16 at a value higher than the characteristic impedance $Z_0$ (normally 50 Ω) of the input and output lines 17, 18 connected to the input and output lines 11 and 12.

According to the first embodiment, the fact that the parallel-coupled lines 14, 16 high in characteristic impedance are parallel-coupled to the main line 13 reduces the radiation loss of the filter due to the radiation from the open ends of the parallel-coupled lines 14, 16, with the result that the insertion loss of the filter is reduced within the pass band of a radio frequency and that the filter attenuation capacity is increased within the stop band of the image signal. Also, since the characteristic impedance of at least two parallel-coupled lines 14 and 16 is set at a high level, the quality factor Q within the stop band of the parallel-coupled lines 14 and 16 is increased, thus producing a filter having a steep rise characteristic. The present embodiment is especially effective as a filter for image rejection used with a mixer having radio frequency signal and an image signal comparatively close to each other, thus realizing superior mixer performance. Also, the filter dimensions are reduced as the parallel-coupled lines 14, 16 are parallel-coupled to the main line.

Figure 2:
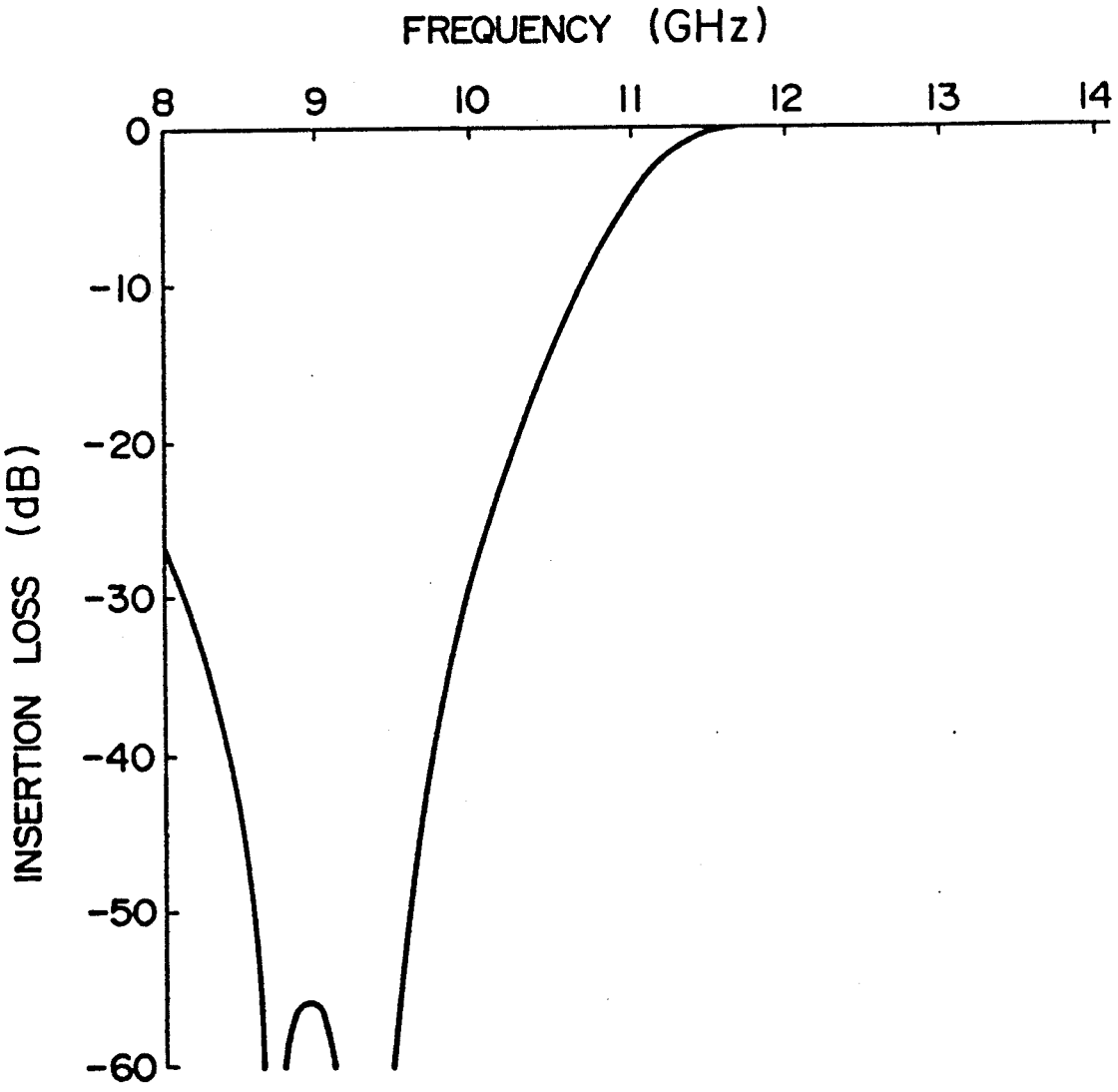
FIG. 2 is a characteristic diagram showing a specific example of the frequency characteristic of insertion loss of the filter circuit shown in FIG. 1.

FIG. 2 shows filter characteristics based dielectric substrate of the strip line is 2.6, the thickness thereof 0.6 mm, the characteristic impedance of the parallel-coupled lines 14, 16 is 120 Ω, the characteristic impedance of the open-ended stub 15 is 50 Ω, and the length $l_0(=l_0')$, $l_1(=l_3)$ and $l_2$ are 6.3 mm, 5.5 mm and 5.6 mm respectively. This computation takes into account the effect of the fringing capacitance which is caused by the edge effect at the open ends of the stub 16 and the parallel-coupled lines 14, 16. The filter shown in FIG. 2 has characteristics including a VSWR (voltage standing-wave ratio) less than two in the frequency range from 11.4 to 14.0 GHz and an attention capacity more than 30 dB in the frequency range from 8.2 to 9.9 GHz. As a result, a filter having the characteristics shown in FIG. 2 sufficiently satisfies the performance required of a signal-pass image-rejection filter for a mixer with an image signal of a frequency from 8.2 to 9.9 GHz and a radio frequency signal from 11.4 to 14.0 GHz. Further, as the intervals $l_0$, $l_0'$ between the parallel-coupled lines and the open-ended stub are selected to be longer than 5/16 and shorter than 7/16 of the wavelength of the radio frequency signal, a filter having an especially superior characteristic is configured. The filter having the characteristic shown in FIG. 2 is selected to have a size satisfying these conditions.

Figure 3:
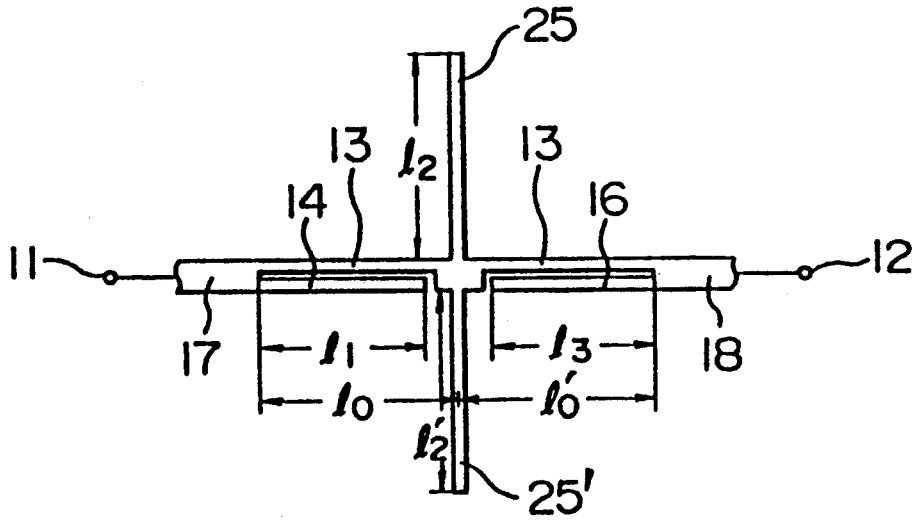
FIG. 3 is a pattern diagram showing a microwave filter circuit configured of a strip line according to a second embodiment of the present invention.

FIG. 3 shows a signal-pass image-rejection filter according to a second embodiment of the present invention. The same component parts as in FIG. 1 will be explained by attaching the same reference numerals as in FIG. 1 respectively. Numerals 25, 25' designate open-ended stubs having the same or substantially the same line lengths $l_2$, $l_2'$ selected to be one fourth or almost one fourth the wavelength of the image signal so that poles of attenuation are positioned within or in the vicinity of the band of the image signal. These stubs are connected at corresponding positions on the opposite sides of the main line 13. Assume that the characteristic impedances of the open-ended stubs 25, 25' are $Z_{25}$ and $Z_{25}'$, that the characteristic impedance of the open-ended stub in FIG. 1 is $Z_{15}$, and that the lengths of the open-ended stubs 15, 25 and 25' are selected so that all the frequencies of the poles of attenuation of the open-ended stubs 15, 25 and 25' are coincident with each other. Then, the filter characteristics in FIGS. 1 and 3 coincide with each other as far as the relationship holds that $1/Z_{15}=1/Z_{25}+1/Z_{25}'$.

In the second embodiment, in addition to the effect of the embodiment shown in FIG. 1, the lengths $l_2$, $l_2'$ of the open-ended stubs 25, 25' are set slightly different from each other, so that there are two poles of attenuation due to the open-ended stubs 25, 25', thereby making it possible to distribute the positions of poles of attenuation over an image signal band, with the result that the amount of attenuation in an image signal band may be averaged out. If a line of a low characteristic impedance is required for the open-ended stub 15 in the embodiment of FIG. 1, an effectively low characteristic impedance may be easily attained by dividing into two open-ended stubs 25, 25' as shown in the second embodiment. In addition, since the line width of the open-ended stubs 25, 25' is kept small, the formation of the stubs, which otherwise might have a wider line, is facilitated in connecting the main line 13 and the open-ended stubs 25, 25'. Furthermore, a filter of especially superior characteristics may be configured by selecting an interval $l_0$, $l_0'$ longer than 5/16 and shorter than 7/16 the wavelength of the radio frequency signal.

Figure 4:
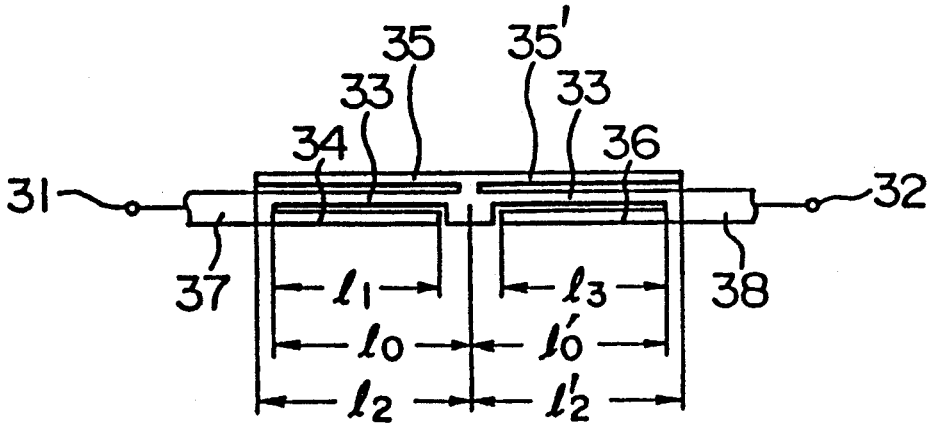
FIG. 4 is a pattern diagram showing a microwave filter circuit configured of a strip line according to a third embodiment of the present invention.

A signal-pass image-rejection filter according to a third embodiment of the present invention is shown in FIG. 4. An input terminal 31 and an output terminal 12 for a radio frequency signal are connected by a main line 33 constituting a strip line. Open-ended parallel-coupled lines 34, 35, 35', 36 having lengths $l_1$, $l_2$, $l_2'$, $l_3$ respectively are coupled in parallel to the main line 33. The parallel-coupled lines 34, 35 (or 35') and 36 are connected to the main line 33 with intervals $l_0$, $l_0'(l_0 \approx l_0')$ respectively. The parallel-coupled lines 34, 35 are disposed in opposed relationship at corresponding positions on the side of a main line portion 33, and the parallel-coupled lines 35', 36 in opposed relationship at corresponding positions on the side of the other main line portion 33. The parallel-coupled lines 34, 35, 35', 36 are selected at lengths $l_1$, $l_2$, $l_2'$, $l_3$ respectively which are one fourth or substantially one fourth the wavelength of the image signal to secure poles of attenuation at positions within or in the vicinity of the image signal band. The lengths $l_1$, $l_2$, $l_2'$, $l_3$ of the parallel-coupled lines 34, 35, 35', 36 and the intervals $l_0$, $l_0'$ of the parallel-coupled lines 34, 35 (or 35') are also determined in such a manner as to satisfy the conditions $l_1 \approx l_2 \approx l_2' < l_0 \approx l_0' < 2l_1$ and $l_3 \approx l_2 \approx l_2' < l_0 \approx l_0' < 2l_3$ at the same time, or the conditions $l_1 = l_3 \approx l_2 \approx l_2' < l_0 \approx l_0' < 2l_1$, while selecting the length $l_0$ at about 15 times one fourth the wavelength of the radio frequency signal. Further, the parallel-coupled lines 34, 36 are selected to have a characteristic impedance higher than the characteristic impedance $Z_0$ (normally 50 Ω) of the input and output lines 37 and 38 connected to the input and output terminals 11 and 12.

According to the third embodiment, in view of the fact that the parallel-coupled lines 34, 35, 35', 36 are coupled in parallel to the main line 33, it is possible to reduce the radiation loss of the filter caused by the radiation from the open ends of the parallel-coupled lines 34, 35, 35', 36, with the result that the insertion loss of the filter is decreased within the pass band of the radio frequency signal, thereby increasing the amount of attenuation of the filter within the rejection band of the image signal. Also, the characteristic impedance of at least two parallel-coupled lines 34, 36 is set high, so that the quality factor (Q) in the stop band of the parallel-coupled lines 34, 36 is high and a filter with a steep rise characteristic is obtained. Especially, an effective and superior mixer performance are realized as a filter for image rejection used with a mixer having a radio frequency signal and an image signal comparatively close to each other. Further, the main line 33 is connected only with the parallel-coupled lines arranged in parallel thereto, and therefore the filter width can be greatly reduced for a smaller filter size. The small filter width works effectively especially when the filter is housed in a case in cut-off region to reduce the radiation effect. Also, the parallel-coupled lines 35, 35' are set to slightly different lengths $l_2$, $l_2'$, so that there are two poles of attenuation due to the parallel-coupled lines 35, 35'. This disperses the positions of the poles of attenuation for the filter as a whole in the image signal band, resulting in a uniform amount of attenuation in the image signal band. In addition, a filter with especially superior characteristics is configured, if a length longer than 5/16 and shorter than 7/16 the wavelength of the radio frequency signal is selected as the interval $l_0$, $l_0'$ of the parallel-coupled lines.

Figure 5:
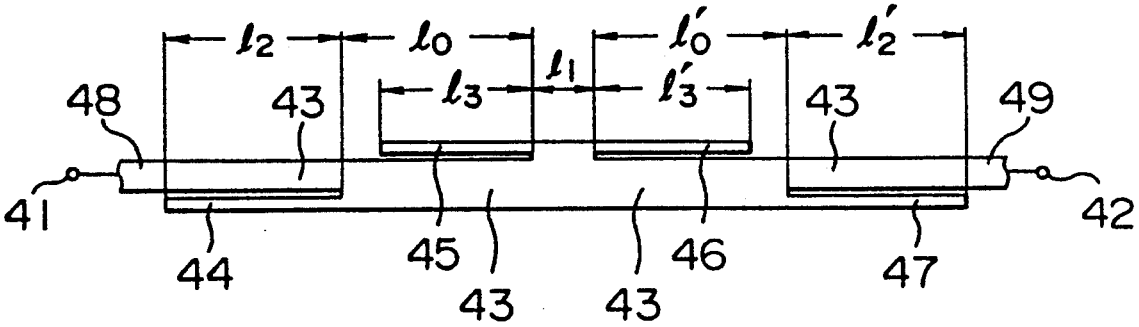
FIG. 5 is a pattern diagram showing a microwave filter configured of a strip line according to a fourth embodiment of the present invention.

A signal-pass image-rejection filter according to a fourth embodiment of the invention is shown in FIG. 5. An input terminal 41 and an output terminal 42 of a radio frequency signal are connected by a main line 43 configured of a strip line. Open-ended parallel-coupled lines 44, 45, 46, 47 having lengths of $l_2$, $l_3$, $l_3'$, $l_2'$ (here, $l_2 \approx l_2'$, $l_3 \approx l_3'$) respectively, are coupled in parallel to the main line 43. The parallel-coupled lines 44, 45, 46, 47 are connected to main line 43 with the intervals $l_0$, $l_1$, $l_0'$ respectively. The parallel-coupled lines 44, 45, 46, 47 are selected at lengths $l_2$, $l_3$, $l_3'$, $l_2'$ which are one fourth or approximately one fourth the wavelength of the image signal so that poles of attenuation may be positioned within or in the vicinity of the image signal band. The lengths $l_2$, $l_3$, $l_3'$, $l_2'$ and the intervals $l_0$, $l_1$, $l_0'$ of the parallel-coupled lines 44, 45, 46, 47 are selected to satisfy the conditions $l_1 < l_3 \approx l_3' < l_0 \approx l_0' < 2l_3 \approx 2l_3'$. At the same time, the length $l_0$, $l_0$, is determined to be about 1.5 times one fourth the wavelength of the radio frequency signal, and the length $l_1$ about 0.5 to 1.0 times one fourth the wavelength of the radio frequency signal. In addition, the characteristic impedance of the parallel-coupled lines 45, 46 with poles of attenuation thereof located on the high-frequency side of the image signal, that is, on the side nearer to the radio frequency signal, is selected to be higher than the characteristic impedance (normally 50 Ω) of the input and output lines 48, 49 connected to the input and output terminals 41, 42.

According to this embodiment, the arrangement of the parallel-coupled lines 44, 45, 46, 47 coupled in parallel to the main line 43 reduces the radiation loss of the filter due to the radiation from the open ends of the parallel-coupled lines 44, 45, 46, 47, with the result that the insertion loss of the filter within the pass band of the radio frequency signal is reduced, thereby increasing the attenuation capacity of the filter within the stop band of the image signal. Also, in view of the fact that the characteristic impedance of the parallel-coupled lines 45, 46 with poles of attenuation located on the side nearer to the pass band of the radio frequency signal is set to a value higher than that of the input and output lines 48, 49, the quality factor within the stop band of the parallel-coupled lines 45, 46 is improved. Further, since the poles of attenuation are composed of the two parallel-coupled lines 45, 46, a filter with a steep rise characteristic is obtained. Furthermore, the arrangement of the parallel-coupled lines 44, 45, 46, 47 in parallel to the main line 43 reduces the whole width of the filter for a smaller filter size.

Figure 6:
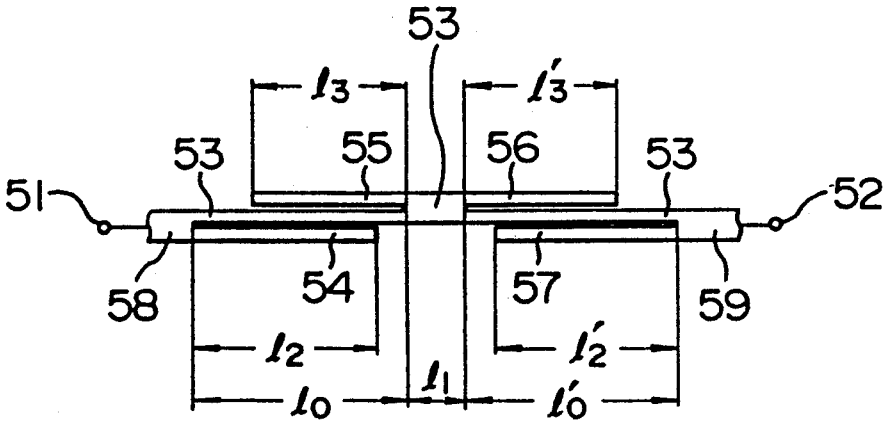
FIG. 6 is a pattern diagram showing a microwave filter configured of a strip line according to a fifth embodiment of the present invention.

FIG. 6 shows a signal-pass image-rejection filter according to a fifth embodiment of the present invention. An input terminal 51 and an output terminal 52 for a radio frequency signal are connected by a main line 53. Open-ended parallel-coupled lines 54, 55, 56, 57 having the lengths of $l_2$, $l_3$, $l_3'$, $l_2'$ (here, $l_2 \approx l_2'$, $l_3 \approx l_3'$) respectively are coupled in parallel to the main line 53. The parallel-coupled lines 54, 55, 56, 57 are connected to the main line 53 with the intervals $l_0$, $l_1$, $l_0'$ respectively. The parallel-coupled lines 54, 55 are arranged in opposed relations to each other on the opposite sides of a main line portion 53, and the parallel-coupled lines 56, 57 in opposed relations to each other on the opposite sides of the other main line portion 53. The parallel-coupled lines 54, 55, 56, 57 are selected at lengths $l_2$, $l_3$, $l_3'$, $l_2'$ which are one fourth or almost one fourth the wavelength of the image signal so that the poles of attenuation thereof are included within or in the vicinity of the image signal band. The lengths $l_2$, $l_3$, $l_3'$, $l_2'$ and the intervals $l_0$, $l_1$, $l_0$ of the parallel-coupled lines 54, 55, 56, 57 are selected to satisfy the conditions $l_1 < l_3 \approx l_3' < l_2 \approx l_2' < l_0 \approx l_0' < 2l_3 = 2l_3'$, while determining the length $l_0$, $l_0'$ at a value about 1.5 times one fourth the wavelength of the radio frequency signal, and the length $l_1$ about 0.5 to 1.0 time one fourth the wavelength of the radio frequency signal. In addition, the characteristic impedance of the parallel-coupled lines 55, 56 with poles of attenuation located on the high frequency side of the image signal, that is, on the side nearer to the radio frequency signal, is selected to be higher than the characteristic impedance (normally 50 Ω) of the input and output liens 58, 59 connected to the input and output terminals 51, 52 respectively.

Figure 7:
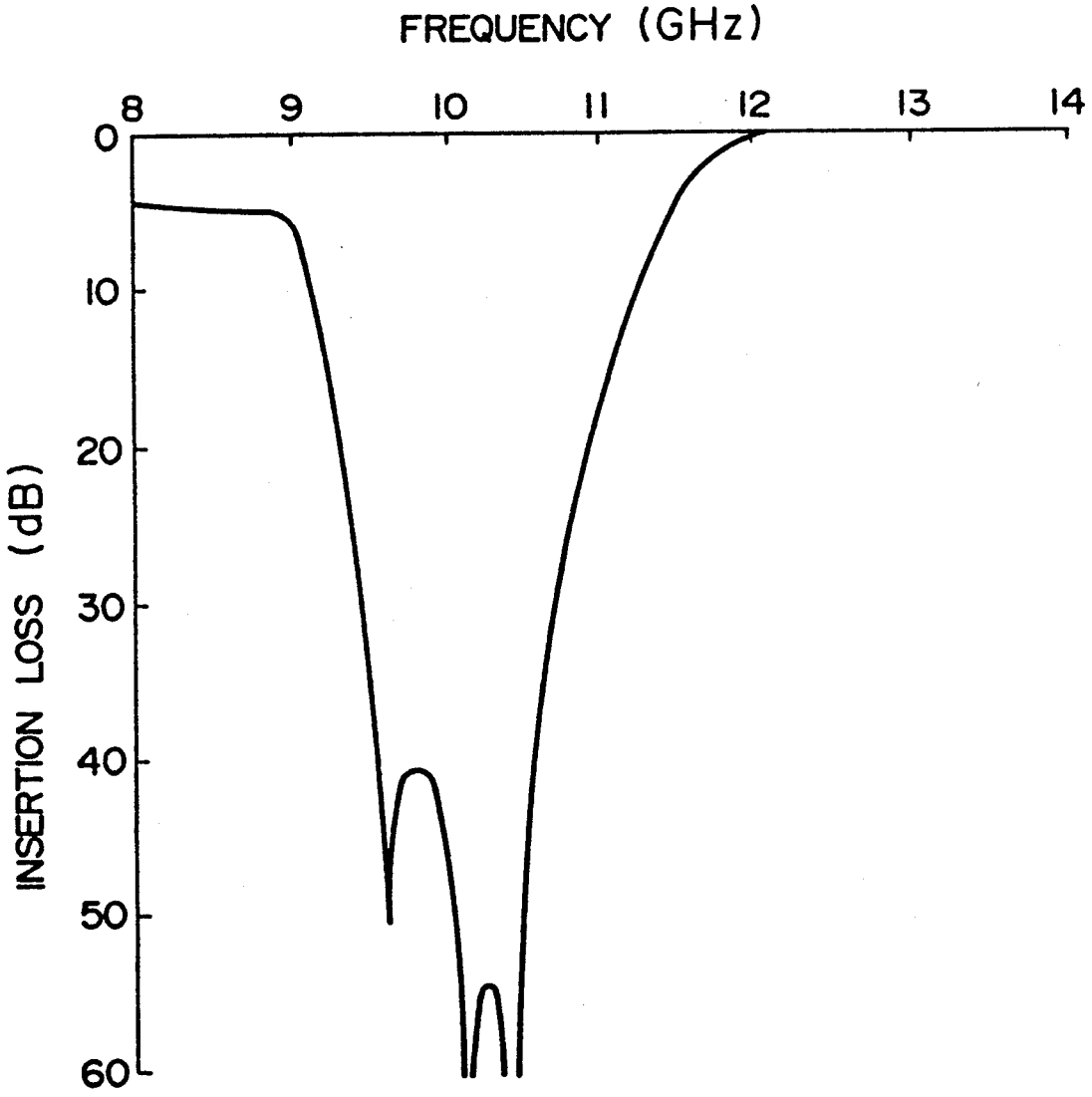
FIG. 7 is a characteristic diagram showing a specific example of the frequency characteristic of insertion loss of the filter circuit shown in FIG. 6.

FIG. 7 shows a filter characteristic assuming that the relative dielectric constant of the dielectric substrate for the strip line is 2.6, the thickness thereof 0.6 mm, the characteristic impedance of the parallel-coupled lines 54, 55, 56, 57 is 120 ohm, the characteristic impedance of the input and output lines 58, 59 is 50 ohm, $l_0 = l_0' = 6.5$ mm, $l_1 = 2.8$ mm, $l_2 = l_2' = 5.5$ mm and $l_3 = l_3' = 5.2$ mm in FIG. 6, while at the same time taking into consideration the fringing capacitance due to the open end effect at the open ends of the parallel-coupled lines 54, 55, 56, 57. In the filter shown in FIG. 7, VSWR is less than 1.4 in the frequency range from 12.1 to 14.0 GHz, so that a characteristic with an attenuation of more than 30 dB is obtained in the frequency range from 9.5 to 10.6 GHz. As a result, the filter having the characteristic as shown in FIG. 7 sufficiently satisfies the performance required of a signal-pass image-rejection filter for a mixer having a radio frequency range from 12.1 to 14.0 GHz and an image signal frequency range from 9.5 to 10.6 GHz. In addition, since the component parts of the filter are limited to parallel-coupled lines, a compact signal-pass image-rejection filter for a mixer is provided, which, very small in insertion loss for a radio frequency signal, is used effectively for rejecting an image signal and passing a radio frequency signal without loss.

According to the embodiment under consideration, the parallel-coupled lines 54, 55, 56, 57 are coupled in parallel to the main line 53, and therefore the radiation loss of the filter due to the radiation from the open ends of the parallel-coupled lines 54, 55, 56, 57 is reduced, with the result that the insertion loss of the filter within the pass band of the radio frequency signal is decreased, thus increasing the filter attenuation capacity within the stop band of the image signal. Also, the characteristic impedance of the parallel-coupled lines 55, 56 with poles of attenuation thereof located on the side nearer to the pass band of the radio frequency signal is selected higher than that of the input and output lines of the filter, so that the quality factor (Q) within the stop band of the parallel-coupled lines 55, 56 is higher. In addition, the fact that the poles of attenuation are comprised of two parallel-coupled lines 55, 56 assures a steep rise characteristic for the filter. Further, the parallel-coupled lines 54, 55, 56, 57 are coupled in parallel to the main line 53 and in opposed relations on the opposite sides thereto, thereby shortening the width and length of the whole filter for a greatly reduced filter size.

Figure 8:
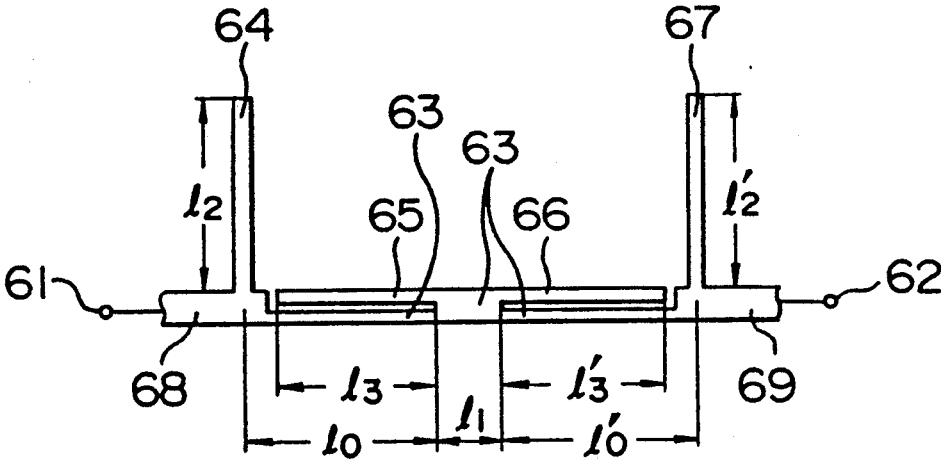
FIG. 8 is a pattern diagram showing a microwave filter configured of a strip line according to a sixth embodiment of the present invention.
Figure 9:
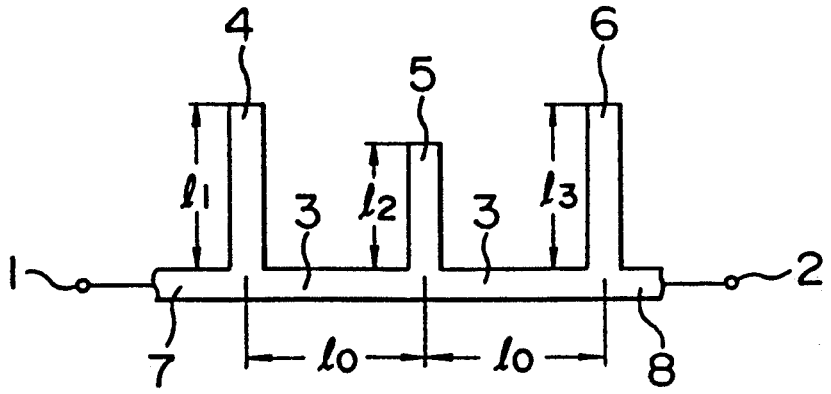
FIG. 9 PRIOR ART
FIG. 9 is a pattern diagram showing a microwave filter circuit configured of a conventional strip line.

FIG. 8 shows a signal-pass image-rejection filter according to a sixth embodiment of the present invention. An input terminal 61 and an output terminal 62 of a radio frequency signal are connected by a main line 63 made up of a strip line. Open-ended stubs 64, 67 having the length $l_2$, $l_2'$ ($l_2 \approx l_2'$) are connected in shunt with the main line 63, while parallel-coupled lines 65, 66 having the length $l_3$, $l_3'$($l_3 \approx l_3'$) are coupled in parallel to the main line 63. The open-ended stub 64, the parallel-coupled lines 65, 66 and the open-ended stub 67 are connected to the main line 63 with intervals of $l_0$, $l_1$, $l_0'$ ($l_0 \approx l_0'$) respectively. The length $l_2$, $l_2'$ of the open-ended stubs 64, 67 and the length $l_2$, $l_2'$ of the parallel-coupled lines 65, 66 are selected to a value one fourth or approximately one fourth the wavelength of the image signal so that the poles of attenuation thereof are placed within or in the vicinity of the image signal band. The length $l_2$, $l_2'$ or the open-ended stubs 64, 67, the length $l_3$, $l_3'$ of the parallel-coupled lines 65, 66 and the intervals thereof $l_0$, $l_1$, $l_0'$ are selected to satisfy the conditions $l_1 < l_3 \approx l_3' < l_2 \approx l_2' < l_0 \approx l_0' < 2l_3 \approx 2l_3'$ while at the same time selecting the length $l_0$, $l_0'$ at a value about 1.5 times one fourth the wavelength of the radio frequency signal and the length $l_1$ about 0.5 to 1.0 time one fourth the wavelength of the radio frequency signal. Further, the characteristic impedance of the parallel-coupled lines 65, 66 with poles of attenuation thereof located on the high frequency side of the image signal, that is, on the side nearer to the radio frequency signal is selected higher than the characteristic impedance (normally 50 ohm) of the input and output lines 68, 69 connected to the input and output terminals 61, 62.

According to this embodiment, the parallel-coupled lines 65, 66 with poles of attenuation thereof located on the side nearer to the radio frequency signal are coupled in parallel to the main line 63. It is thus possible to reduce the radiation loss of the filter due to the radiation from the open ends of the parallel-coupled lines 65, 66, with the result that the insertion loss of the filter in the pass band of the radio frequency signal, in particular, can be reduced. Also, in view of the fact that the characteristic impedance of the parallel-coupled lines 65, 66 with poles of attenuation thereof located on the side nearer to the pass band of the radio frequency signal is set higher than that of the input and output lines 68, 69 of the filter, the quality factor within the stop band of the parallel-coupled lines 65, 66 is high. In addition, the poles of attenuation are comprised of two parallel-coupled lines 65, 66, and therefore a filter is obtained with a steep rise characteristic. Further, the use of the parallel-coupled lines 65, 66 reduces the size of the filter as a whole.

Further, a filter with an especially superior characteristic is configured, if the interval $l_0$, $l_0'$ of open-ended lines or subs is selected longer than 5/16 and shorter than 7/16 the wavelength of the pass-band frequency (or radio frequency signal), and the interval $l_1$ is determined longer than $\frac{1}{8}$ and shorter than 2/8 the wavelength of the pass-band frequency. The filter having the characteristic shown in FIG. 7 is selected to have a filter size satisfying these conditions.

As will be understood from the foregoing description, the present invention has the advantages described below.

(1) Parallel-coupled lines having a high characteristic impedance are coupled in parallel to a main line, and therefore the radiation loss of the filter due to the radiation from the open ends of the parallel-coupled lines is reduced, with the result that the insertion loss of the filter within the pass band of a radio frequency signal is decreased, thereby increasing the amount of attenuation of the filter within the stop band of an image signal.

(2) In view of the fact that the characteristic impedance of at least two parallel-coupled lines is set high as compared with the characteristic impedance (normally 50 ohm) of input and output lines, the quality factor within the stop band of the parallel-coupled lines is high, thus producing a steep rise characteristic of the filter. This is especially effective with a filter for image rejection used with a mixer having a radio frequency signal comparatively close to an image signal, thus realizing a superior mixer performance.

(3) In the case where open-ended lines are connected at four points of a main line, the length $l_2$, $l_2'$, $l_3$, $l_3'$ of the parallel-coupled lines or open-ended stubs are selected equal to or substantially equal to one fourth the wavelength of an image signal so that poles of attenuation thereof are placed within or in the vicinity of the image signal band. And the lengths $l_2$, $l_2'$, $l_3$, $l_3'$ and the intervals $l_0$, $l_1$, $l_0'$ of the parallel-coupled lines or the open-ended stubs are selected to satisfy the conditions $l_1 < l_3 \approx l_3' < l_2 \approx l_2' < l_0 \approx l_0' < 2l_3 \approx 2l_3'$ thereby providing a filter having a more steep rise characteristic and a wide pass bandwidth.

(4) In the case where open-ended lines are connected at three points of a main line, the lengths $l_1$, $l_2$, $l_2'$, $l_3$ of the parallel-coupled lines and the open-ended stub are selected at a value one fourth or substantially one fourth the wavelength of the image signal so that poles of attenuation come within or in the vicinity of the image signal band. The length $l_1$, $l_2$, $l_2'$, $l_3$ and the interval $l_0$, $l_0'$ of the parallel-coupled lines and the open-ended stub, on the other hand, are determined to satisfy the conditions $l_1 \approx l_2(\approx l_2') < l_0 \approx l_0' < 2l_1$ and $l_3 \approx l_2(\approx l_2') < l_0 \approx l_0' < 2l_3$ at the same time, or $l_1 = l_3 \approx l_2(\approx l_2') < l_0 \approx l_0' < 2l_1$, whereby a filter is provided which has a more steep rise characteristic and a wider pass band.

If the interval $l_0$, $l_0'$ is selected to be longer than 5/16 and shorter than 7/16 the wavelength of a radio frequency signal, it is possible to configure a filter especially superior in rise characteristic and pass band width (5) Parallel-coupled lines coupled distributively in parallel to a main line are used as open-ended lines connected to the main line, and therefore the size of the whole filter is reduced.

I claim:

1. A microwave filter comprising:

a main line having an input terminal and an output terminal; and first, second and third open-ended lines, each connected to said main line with an equal or nearly equal interval $l_0$, $l_0'$($l_0 \approx l_0'$) respectively and having a length of $l_1$, $l_2$ and $l_3$, respectively;

wherein said first and third lines are constituted with open-ended parallel-coupled lines arranged in parallel to the main line, said second line is constituted with an open-ended stub arranged in shunt with said main line, the lengths $l_1$, $l_2$ and $l_3$ of said first, second and third lines are selected to be equal to the $\frac{1}{4}$ wavelength of a stop-band frequency such that the poles of attenuation thereof are positioned within a stop band, the lengths $l_0$, $l_0'$, $l_1$, $l_2$ and $l_3$ are selected to satisfy a condition of $l_1 < l_2 < l_0 \approx l_0' < 2l_1$ and $l_3 < l_2 < l_0 \approx l_0' < 2l_3$ or to satisfy a condition $l_1 = l_3 < l_2 < l_0 \approx l_0' < 2l_1$, and the characteristic impedance of at least the first and third lines is selected to be higher than that of the input and output lines connected to the input and output terminals, and the interval $l_0$, $l_0'$, between the first, second and third open-ended lines is selected to be longer than 5/16 wavelength of a pass-band frequency but shorter than 7/16 wavelength of said pass-band frequency.

2. A microwave filter comprising:

a main line having an input terminal and an output terminal; and first, second, third and fourth open-ended lines, each connected to said main line with an equal or nearly equal interval $l_0$, $l_0'(l_0 \approx l_0')$, respectively and having a length of $l_1$, $l_2$, $l_2'$ and $l_3$, respectively, wherein the second and third lines of equal or substantially equal lengths, $l_2$, $l_2'$ respectively are constituted with open-ended stubs arranged in shunt with the main line, extending across said main line on both sides of said main line at the same position, the first and fourth lines are constituted with open-ended parallel-coupled lines arranged in parallel to the main line, the lengths $l_1$, $l_2$, $l_2'$ and $l_3$ of the first, second, third and fourth lines are selected to be the $\frac{1}{4}$ wavelength of a stop-band frequency such that the poles of attenuation thereof are positioned within a stop band, the lengths $l_0$, $l_1$, $l_2$, $l_2'$ and $l_3$ are selected to satisfy a condition of $l_1 \approx l_2 \approx l_2' < l_0 \approx l_0' < 2l_1$ and $l_3 \approx l_2 \approx l_2' < l_0 \approx l_0' < 2l_3$ or to satisfy a condition $l_1 = l_3 \approx l_2 \approx l_2' < l_0 \approx l_0' < 2l_1$, and the characteristic impedance of at least the first and fourth lines is selected to be higher than that of the input and output lines connected to the input and output terminals.

3. A microwave filter comprising:

a main line having an input terminal and an output terminal; and first, second, third and fourth open-ended lines, each connected to said main line with an equal or nearly equal interval $l_0$, $l_0'(l_0 \approx l_0')$ respectively and having a length of $l_1$, $l_2$, $l_2'$ and $l_3$ respectively, wherein the second and third lines of equal or substantially equal lengths $l_2$, $l_2'$ respectively are constituted with open-ended parallel-coupled lines arranged in parallel to said main line, the first and fourth lines are constituted with open-ended parallel-coupled lines arranged in parallel to the main line, said first and second lines are arranged in corresponding opposed relationship to each other on the opposite sides of said main line, said third and fourth lines are arranged in corresponding opposed relationship to each other on the opposite sides of said main line, the lengths $l_1$, $l_2$, $l_2'$ and $l_3$ of the first, second, third and fourth lines are selected to be the $\frac{1}{4}$ wavelength of a stop-band frequency such that the poles of attenuation thereof are positioned within a stop band, the lengths $l_0$, $l_1$, $l_2$, $l_2'$ and $l_3$ are selected to satisfy a condition of $l_1 \approx l_2 \approx l_2' < l_0 \approx l_0' < 2l_1$ and $l_3 \approx l_2 \approx l_2' < l_0 \approx l_0' < 2l_3$ or to satisfy a condition $l_1 = l_3 \approx l_2 \approx l_2' < l_0 \approx l_0' < 2l_1$, and the characteristic impedance of at least the first and fourth lines is selected to be higher than that of the input and output lines connected to the input and output terminals.

4. A microwave filter according to claim 2, wherein the interval $l_0$, $l_0'$ of the first, second, third and fourth lines is selected to be longer than 5/16 wavelength of a pass-band frequency but shorter than 7/16 the wavelength of said pass-band frequency.

5. A microwave filter according to claim 3, wherein the interval $l_0$, $l_0'$ of the first, second, third and fourth lines is selected to be longer than 5/16 wavelength of pass-band frequency but shorter than 7/16 wavelength of said pass-band frequency.

6. A microwave filter comprising:

a main line having an output terminal and an input terminal; and first, second, third and fourth open-ended lines, each connected to said main line with an interval $l_0$, $l_1$, $l_0'$ $(l_0 \approx l_0')$ respectively and having a length of $l_2$, $l_3$, $l_3'$ and $l_2'$ respectively, wherein said first, second, third and fourth lines are coupled in parallel to said main line, said lengths $l_2$, $l_3$, $l_3'$, $l_2'$ being selected to be the $\frac{1}{4}$ wavelength of a stop-band frequency so that the poles of attenuation thereof are positioned within a stop band, said lengths $l_0$, $l_0'$, $l_1$, $l_2$, $l_2'$, $l_3$, $l_3'$ being selected to satisfy a condition $l_1 < (l_3$ and $l_3') < (l_2$ and $l_2') < (l_0$ and $l_0') < (2l_3$ and $2l_3')$ or to satisfy a condition $l_1 < l_3 \approx l_3' < l_2 \approx l_2' < l_0 \approx l_0' < (2l_3$ and $2l_3')$.

7. A microwave filter according to claim 6, wherein the first and second parallel-coupled lines are at corresponding positions in opposed relationship to each other on the opposite sides of said main line, and the third and fourth parallel-coupled lines are at corresponding positions in opposed relationship to each other on the opposite sides of the main line.

8. A microwave filter according to claim 6, wherein the characteristic impedance of said first, second, third and fourth open-ended parallel-coupled lines is selected to be higher than that of the input and output lines connected to the input and output terminals respectively.

9. A microwave filter comprising:

a main line having an input terminal and an output terminal; and first, second, third and fourth open-ended lines, each connected to said main line with an interval $l_0$, $l_1$, $l_0'$ $(l_0 \approx l_0')$ respectively and having a length of $l_2$, $l_3$, $l_3'$ and $l_2'$ respectively, wherein said first and fourth lines constitute open-ended stubs arranged in shunt with the main line, said second and third lines constitute open-ended parallel-coupled lines arranged in parallel to the main line, the lengths $l_2$, $l_3$, $l_3'$, $l_2'$ of the first, second, third and fourth lines are selected to be the $\frac{1}{4}$ wavelength of a stop-band frequency so that the poles of attenuation thereof are positioned within a stop band, and the lengths $l_0$, $l_0'$, $l_1$, $l_2$, $l_2'$, $l_3$, $l_3'$ are selected to satisfy a condition $l_1 < (l_3$ and $l_3') < (l_2$ and $l_2') < (2l_3$ and $2l_3')$ or to satisfy a condition $l_1 < l_3 \approx l_3' < l_2 \approx l_2' < (2l_3$ and $2l_3')$.

10. A microwave filter according to claim 9, wherein the characteristic impedance of the first, second, third and fourth open-ended lines is selected to be higher than that of the input and output lines connected to the input and output lines respectively.

* * * * *